US006748191B2

(12) United States Patent
Yamamoto et al.

(10) Patent No.: US 6,748,191 B2
(45) Date of Patent: Jun. 8, 2004

(54) FIXING UNIT HAVING A SEPARATOR PLATE FOR SEPARATING A PRINT MEDIUM FROM A ROLLER

(75) Inventors: Tsutomu Yamamoto, Tokyo (JP); Naoki Sunaga, Tokyo (JP); Tatsuya Murakami, Tokyo (JP); Masato Sakai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/281,139

(22) Filed: Oct. 28, 2002

(65) Prior Publication Data

US 2003/0081970 A1 May 1, 2003

(30) Foreign Application Priority Data

Nov. 1, 2001 (JP) ..... 2001-336651
Oct. 21, 2002 (JP) ..... 2002-305398

(51) Int. Cl.[7] ..... G03G 15/20
(52) U.S. Cl. ..... 399/323
(58) Field of Search ..... 399/323, 398, 399/399, 406

(56) References Cited

U.S. PATENT DOCUMENTS 6,564,030 B2 * 5/2003 Baughman et al. ..... 399/323

* cited by examiner

*Primary Examiner*—William J. Royer
(74) *Attorney, Agent, or Firm*—Rabin & Berdo, PC

(57) ABSTRACT

An electrophotographic image recording apparatus incorporates a fixing unit in which a toner image deposited on a print medium is fused by heat under pressure. The fixing unit includes a fixing member and a separator plate. The fixing member is in pressure contact with a pressure member. The separator plate that is disposed close to the fixing member and has a longitudinal portion extending in a direction transverse to a transport path of the print medium. The separator plate has a mid portion of the longitudinal portion. The mid portion has resiliency to extend away from the transport path and a guide member that pushes the mid portion of the separator plate to maintain the entire longitudinal portion flat so that mid portion is prevented from extending away from the transport path.

18 Claims, 13 Drawing Sheets

FIXING UNIT HAVING A SEPARATOR PLATE FOR SEPARATING A PRINT MEDIUM FROM A ROLLER

BACKGROUND OF THE INVENTION

1. Field of the Invention

The present invention relates to a fixing unit that applies heat and pressure to a toner image, which has been transferred onto a print medium, so as to fix the toner image.

2. Description of the Related Art

A conventional fixing unit for use in an electrophotographic image recording apparatus includes a fixing roller that has a built-in heater and a pressure roller that rotates in pressure contact with the fixing roller. A toner image is transferred onto a print medium and is delivered to the fixing unit. The fixing roller and the pressure roller rotate in such a way that the print medium is sandwiched between the fixing roller and the pressure roller and is advanced forward. The print medium is positioned relative to the fixing roller so that the toner image directly faces the fixing roller and is heated under pressure to be fixed on the print medium permanently.

When the toner is fused, it acquires viscosity so that the print medium is apt to stick to the fixing roller. In order to ensure that the print medium separates from the fixing roller, a separator tongue is provided in an abutting relation with the fixing roller to strip the print medium from the fixing roller.

However, with the aforementioned conventional fixing unit, the separator tongue is in contact with the fixing roller and therefore may scratch the fixing roller. Also, toner that failed to be fixed may be deposited on the separator tongue and cause poor print quality. An area of the fixing roller in contact with the separator tongue may change in surface roughness, causing variations in gloss of printed images.

SUMMARY OF THE INVENTION

The present invention was made in view of the aforementioned problems.

An object of the invention is to provide a fixing unit in which a toner image deposited on a medium is fused by heat under pressure. The fixing unit includes a fixing member; and a separator plate that is disposed near the fixing member to extend in a direction transverse to a transport path through which the print medium travels.

The separator plate may have a mid portion that extends away from the transport path and a guide member that pushes the mid portion of the separator plate to prevent the separator plate from extending away from the transport path. The fixing unit may further include a member for absorbing thermal expansion of the separator plate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
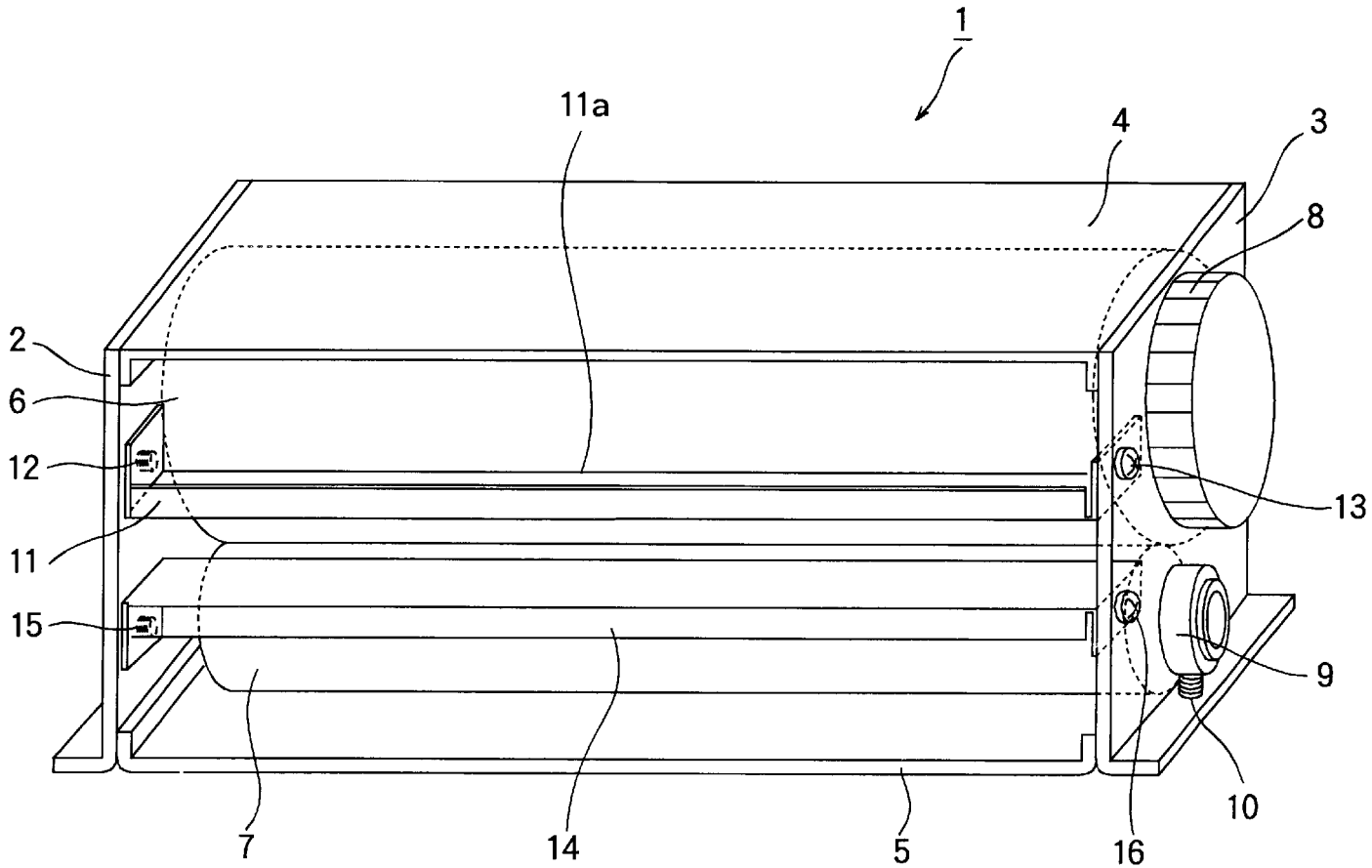
FIG. 1 is a perspective view of a fixing unit according to a first embodiment.

FIG. 1 is a perspective view of a fixing unit according to a first embodiment.

Figure 2:
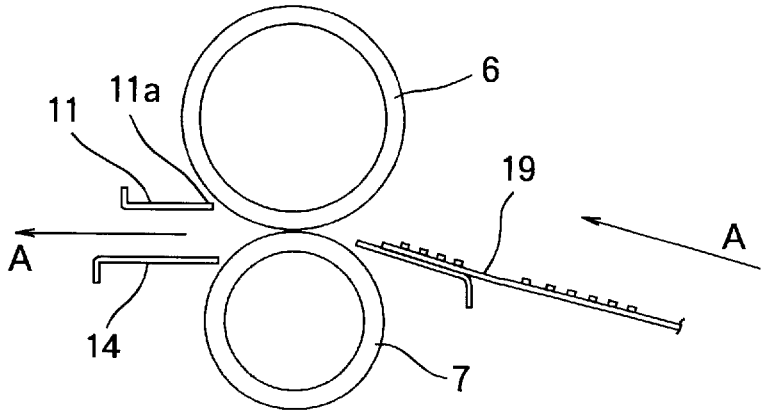
FIG. 2 is a cross-sectional side view of the fixing unit according to the first embodiment.

FIG. 2 is a cross-sectional side view of the fixing unit according to the first embodiment.

Referring to FIGS. 1 and 2, the fixing unit includes a left side frame 2 and a right side frame 3, a top frame 4, and a bottom frame 5. The top frame 4 and bottom frame 5 are fixedly mounted to the side frames 2 and 3. A fixing roller 6 and a pressure roller 7 are mounted on the side frames 2 and 3 by means of bearings so that the fixing roller 6 and pressure roller 7 are rotatable on the bearings. The fixing roller 6 and pressure roller 7 form a fixing unit according to the present invention.

The one end portion of a rotating shaft of the fixing roller 6 extends outwardly of the right side frame 3 and has a gear 8 attached to the end portion. A driving motor, not shown, generates a driving force, which in turn is transmitted to the fixing roller 6 via the gear 8. The pressure roller 7 has a shaft that extends outwardly of the left side frame 2 and right side frame 3 and bosses 9 (only one boss is shown) attached to the end portions of the shaft. The bosses 9 are movable toward and away from the fixing roller 6 and are urged against the fixing roller 6 by springs 10.

A separator plate 11 extends across and parallel to a length of the fixing roller 6. The separator plate 11 is fixed to the left and right side frames 2 and 3 by means of screws 12 and 13, respectively, so that a predetermined gap is defined between the separator plate 11 and the fixing roller 6. When a print medium 19 is advanced while being tacked to the surface of the fixing roller 6, a tip 11*a* of the separator plate 11 enters a gap between the leading end of the print medium 19 and the surface of the fixing roller 6 as shown in FIG. 2.

A separator plate 14 extends across and parallel to the length of the pressure roller 7. The separator plate 14 is fixed to the left and right side frames 2 and 3 by means of screws 15 and 16 so that there is a predetermined gap between the separator plate 11 and the fixing roller 6. The gap need not be any particular size. As shown in FIG. 2, the separator plates 11 and 14 extend substantially horizontally so that the print medium 19 can pass between the separator plates 11 and 14 without difficulty.

The operation of the fixing unit according to the first embodiment will be described. Referring to FIG. 2, the fixing roller 6 is driven to rotate clockwise by the driving motor, not shown. The pressure roller 7 is in pressure contact with the fixing roller 6 and is driven to rotate counterclockwise by the fixing roller 6. The print medium 19 on to which the toner image has been transferred advances in a direction shown by arrow A. When the print medium 19 enters between the fixing roller 6 and the pressure roller 7, the toner 18 melts and is fused to the print medium 19.

Figure 3:
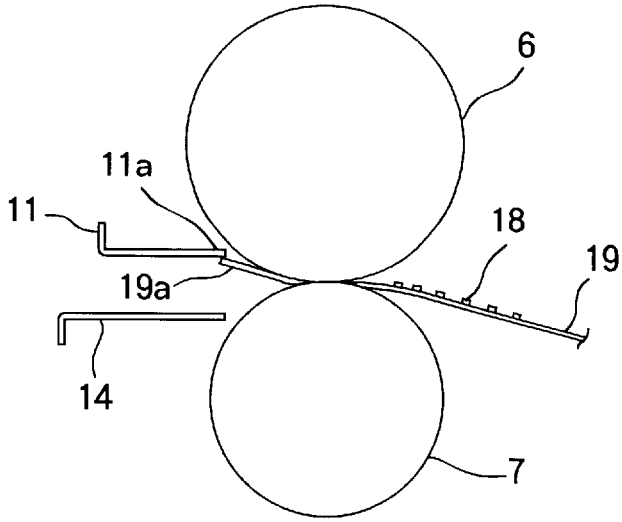
FIGS. 3 and 4 illustrate the print medium just before it is detacked from the fixing roller.

FIG. 3 illustrates the print medium 19 just before it is detacked from the fixing roller 6. The melted toner 18 acquires viscosity so that the print medium 19 becomes tacked to the surface of the fixing roller 6. Thus, the print medium 19 passing a nip formed between the fixing roller 6 and the pressure roller 7 becomes tacked to the surface of the fixing roller 6 while rotating together with the fixing roller 6. However, usually the toner 18 is not deposited on the leading end portion 19*a* of the print medium 19 and the print medium 19 usually has some resiliency. Therefore, as is clear from FIG. 3, the tip 19*a* of the print medium 19 is not tacked to the fixing roller 6.

Then, the leading end 19*a* of the print medium 19 abuts the underside of the tip 11*a* of the separator plate 11, so that the print medium 19 separates from the fixing roller 6 and is directed to pass under the separator plate 11. Then, the print medium 19 is discharged to a stacker through the space defined between the separator plates 11 and 14.

The gap between the separator plate 11 and the fixing roller 6 is required to be shorter than the spacing between the leading end 19*a* of the print medium 19 and the fixing roller 6. The gap between the leading end 19*a* of the print medium 19 and the fixing roller 6 depends on the resiliency and rigidity of the print medium 19. The less resiliency and rigidity of the print medium 19, the shorter the distance between the surface of the fixing roller 6 and the leading end 19*a* of the print medium 19. Thus, the gap should be smaller than the distance between the surface of the fixing roller 6 and the leading end of the print medium 19 having the least resiliency and rigidity. Specifically, the gap is about 1 mm for a print medium 19 having a ream weight of 50 kg (weight per 1000 pages of print paper), which has the least resiliency and rigidity.

Figure 4:
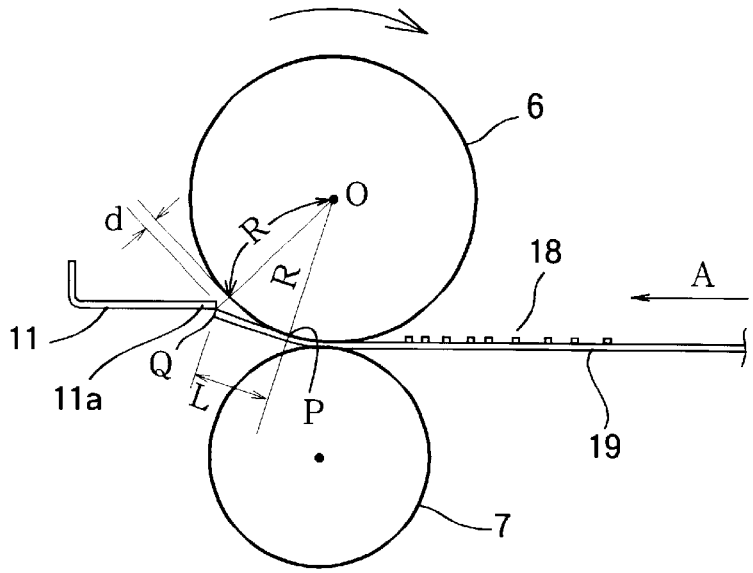

FIG. 4 illustrates a gap defined between the separator plate 11 and the fixing roller 6 in detail.

Figure 5:
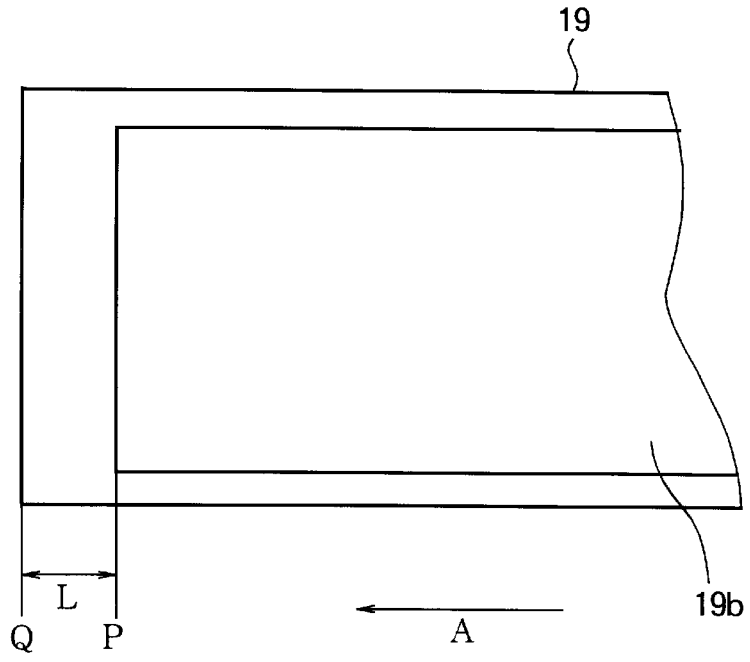
FIG. 5 illustrates the relationship between a tip of the print medium and a top margin of the print medium.

FIG. 5 illustrates the relationship between the tip of the print medium 19 and a top margin of the print medium.

With the fixing unit for an electrophotographic recording apparatus, the distance L between the leading end Q of the print medium 19 and a forward end P of a print region 19*b* on the print medium 19 is set to a predetermined value. The distance L is referred to as top margin in which printing is prohibited. In other words, the toner 18 is not transferred on the top margin L, and therefore an area near the leading end 19*a* of the print medium 19 will not become tacked to the surface of the fixing roller 6.

However, the toner 18 is deposited on the print region 19*b*, and the print region 19*b* of the print medium 19 will become tacked to the surface of the fixing roller 6. The top margin L extends in a direction tangent to the circumferential surface of the fixing roller 6. Here, we apply the Pythagorean theorem to a triangle OPQ in FIG. 4 and get the following relation.

$$(d+R)^2=R^2+L^2 \qquad \text{Eq. (1)}$$

$$d=-R+\sqrt{R^2+L^2} \qquad \textit{Eq. (2)}$$

It is necessary to arrange the separator, plate 11 such that the tip 11*a* is closer to the surface of the fixing roller 6 than the leading end Q of the print medium 19. Thus, d should be in the following range.

$$0<d<-R+\sqrt{R^2+L^2} \qquad \textit{Eq. (3)}$$

As described above, according to the first embodiment, the print medium 19 is separated from the surface of the fixing roller 6 by means of the separator plate 11 that is disposed not to contact the fixing roller 6, so that the fixing roller 6 is prevented from being damaged. This prevents poor print quality that would result if the separator plate 11 is in contact with the fixing roller 6.

The separator plate 14 for the pressure roller 7 cooperates with the separator plate 11 to define the transport path of the print medium 19 in which the print medium 19 passes after fixing. The print medium 19 may become tacked to the surface of the pressure roller 7 when a toner image has been transferred on the side of the print medium 19 that faces the pressure roller 7. Then, the separator plate 14 separates the print medium 19 from the pressure roller 7. For this reason, the gap between the separator plate 14 and the pressure roller 7 is selected to be substantially the same as the gap between the separator plate 11 and the fixing roller 6.

Second Embodiment

Figure 6:
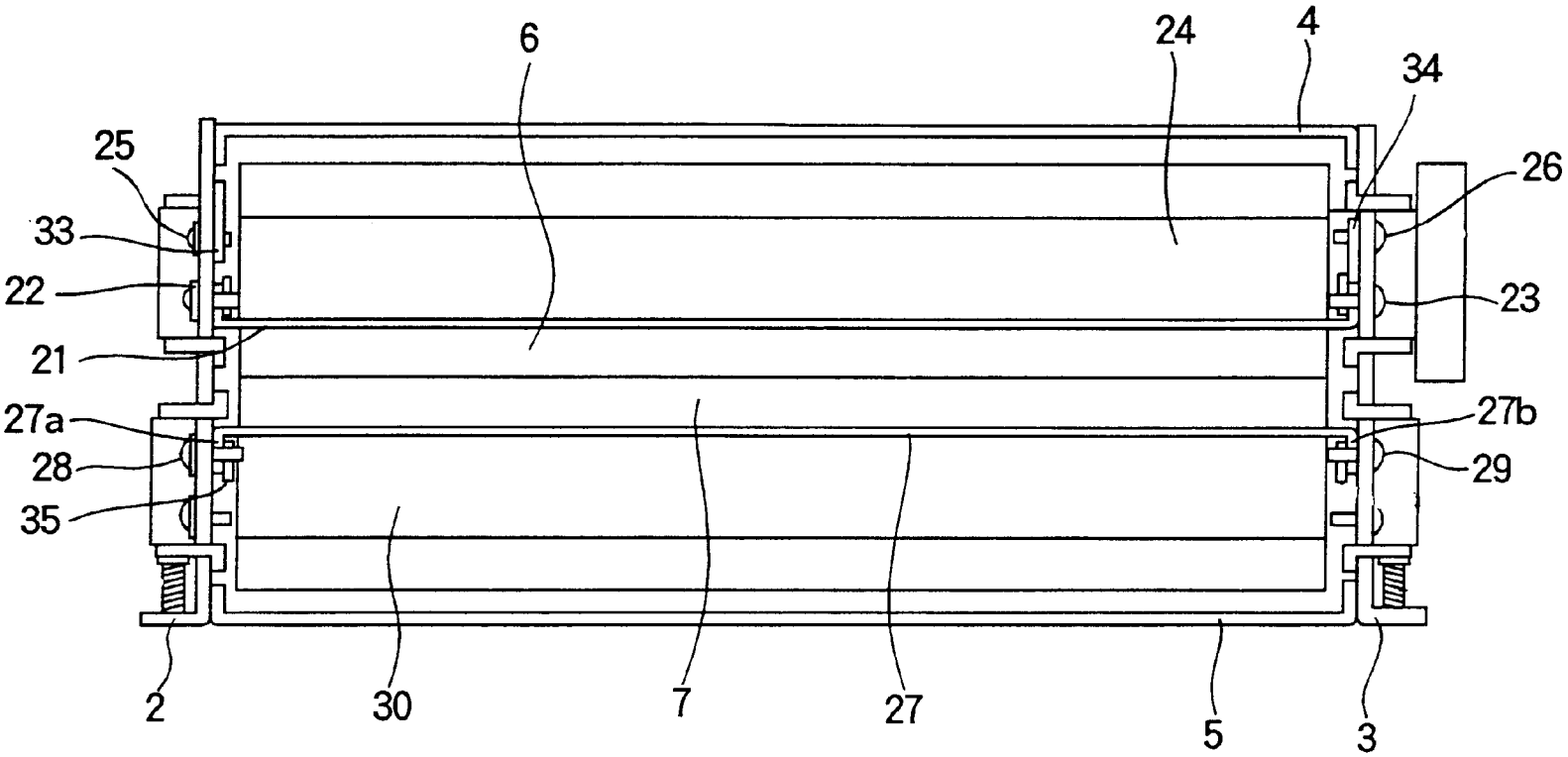
FIG. 6 is a front view of a fixing unit according to a second embodiment.

FIG. 6 is a front view of a fixing unit according to a second embodiment.

Figure 7:
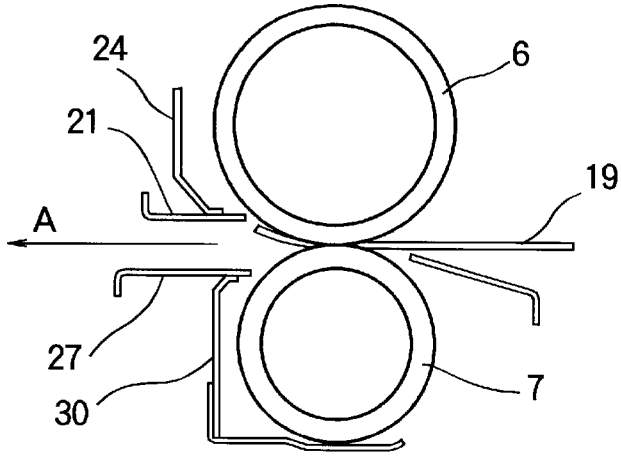
FIG. 7 is a side view of the fixing unit in FIG. 6.

FIG. 7 is a side view of the fixing unit in FIG. 6.

Figure 8:
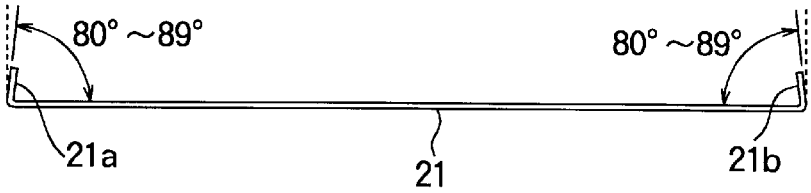
FIG. 8 is a front view of a separator plate according to the second embodiment.

FIG. 8 is a front view of a separator plate 21 according to the second embodiment.

Referring to FIGS. 6 and 7, a fixing unit according to the second embodiment includes a left side frame 2, and a right side frame 3, a top frame 4, and a bottom frame 5. A fixing roller 6 and the pressure roller 7 are rotatably mounted on the left side frame 2 and right side frame 3 by means of bearings.

Figure 9:
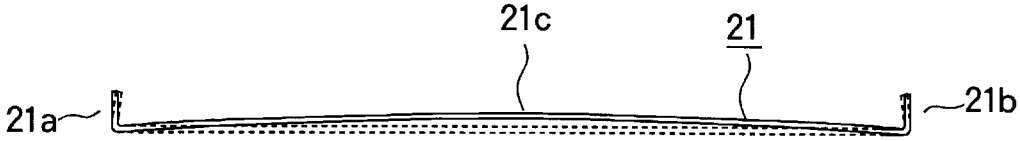
FIG. 9 is a front view illustrating the outwardly extending mid portion of the separator plate.

A separator plate 21 extends parallel to and across a length of the fixing roller 6. The separator plate 21 is fixedly mounted to the left side frame 2 and the right side frame 3 by means of screws 22 and 23. A mounting portion 21*a* of the separator plate 21 is held between the left side frame 2 and a washer 33 by means of the screw 22. A mounting portion 21*b* of the separator plate 21 is held between the right side frame 3 and a washer 34 by means of the screw 23. The separator plate 21 is bent at its longitudinal end portions to form the mounting portions 21*a* and 21*b* so that the mounting portions 21*a* and 21*b* make angles in the range of 80 to 89 degrees with the longitudinally extending portion. Upon assembling the separator pate 21 to the left side frame 2 and right side frame 3, the mounting portions 21*a* and 21*b* are forced to extend outwardly so that a mid portion 21*c* of the longitudinal portion warps to extend upward. FIG. 9 is a front view illustrating the outwardly extending mid portion 21*c* of the separator plate 21. Referring to FIG. 9, dotted lines illustrate the separator plate 21 before mounting and solid lines illustrate the separator plate 21 after mounting.

A separator plate guide 24 is supported on the left side frame 2 and right side frame 3, being fixed by means of screws 25 and 26. The separator plate guide 24 is assembled in contact with the top surface of the separator plate 21. The separator plate guide 24 pushes down the upwardly extending mid portion 21*c* of the separator plate 21, so that at least the tip of the separator plate 21 extends horizontal. When the tip of the separator plate 21 becomes flat and horizontal, the gap between the fixing roller 6 and the tip is about 1 mm.

A separator plate 27 extends in a direction parallel to the pressure roller 7 and is fixed to the left side frame 2 and right side frame 3 by means of screws 28 and 29. A mounting portion 27*a* of the separator plate 27 is held between the left side frame 2 and a washer 35 by means of the screw 28. Just as the separator plate 21, the separator plate 27 has a generally U-shaped cross section with mounting portions 27*a* and 27*b* bent inwardly. That is, the mounting portions 27*a* and 27*b* make angles in the range of 80 to 89 degrees with the longitudinal portion of the separator plate 27. Upon assembling the separator plate 27 to the left side frame 2 and right side frame 3, the mounting portions 27*a* and 27*b* are forced to extend outwardly so that the middle of the longitudinal portion of the separator plate 27 warps to extend downward.

A separator plate guide 30 is fixed to the left side frame 2 and right side frame 3 by means of screws (not shown). The separator plate guide 30 is assembled in contact with the underside of the separator plate 27. The separator plate guide 30 pushes up a downwardly extending mid portion of the separator plate 27, so that at least the tip of the separator plate 27 extends horizontal.

The fixing operation of the second embodiment will be described. Referring to FIG. 7, the fixing roller 6 is driven by a drive motor, not shown, to rotate clockwise. The pressure roller 7 is in pressure contact with the fixing roller 6 and is driven by the fixing roller 6 to rotate counterclockwise. A print medium 19 on which the toner has been fused is advanced in the direction shown by arrow A. When the print medium 19 enters the nip formed between the fixing roller 6 and the pressure roller 7, the fixing roller 6 supplies heat and the pressure roller 7 applies pressure to the print medium 19 to cause the toner 48 to melt and fuse on the print medium 19.

The melted toner acquires viscosity, so that the toner sticks to the surface of the fixing roller 6. Thus, the print medium 19, which passes the nip formed between the fixing roller 6 and the pressure roller 7, rotates while becoming tacked to the fixing roller 6. As described above, the leading end 19*a* of the print medium 19 is off the surface of the fixing roller 6 creating a small gap between the leading end and the surface of the fixing roller 6. The tip of the separator plate 21 enters the small gap between the leading end of the print medium 19 and the surface of the fixing roller 6 to separate the print medium 19 from the fixing roller 6.

Because the separator plates 21 and 27 are disposed near the fixing roller 6, the separator plates 21 and 27 can expand thermally due to the heat supplied from a heater roller, not shown, provided in the fixing roller 6. The separator plate guide 24 holds the separator plate 21. The portion of the separator plate 21 that tends to warp upwardly away from the transport path of the print medium 19 is forcibly held flat and horizontal by the separator plate guide 24. Thus, when the separator plate 21 expands due to heat, the middle portion 21*c* of the tip of the separator plate 21 necessarily extends upwardly.

The lower separator plate 27 is caused to warp downward and the separator plate guide 30 forcibly maintains the separator plate 27 to extend flat and horizontal. Thus, when the separator plate 27 expands thermally, it necessarily extends downward. Therefore, the deformation of the separator plates does not make the transport path of the print medium 19 narrow but ensures a sufficient height of the transport path. The separator plate guides 24 and 30 restrict the deformation of the separator plates 21 and 27 due to thermal expansion, so that the separator plates 21 and 27 will not deform significantly, not affecting seriously the separation of the print medium 19 from the fixing roller 6.

As described above, the second embodiment not only offers the same advantages as the first embodiment but also ensures the height of the transport path of the print medium 19 even when the separator plates 21 and 27 expand thermally.

Third Embodiment

Figure 10:
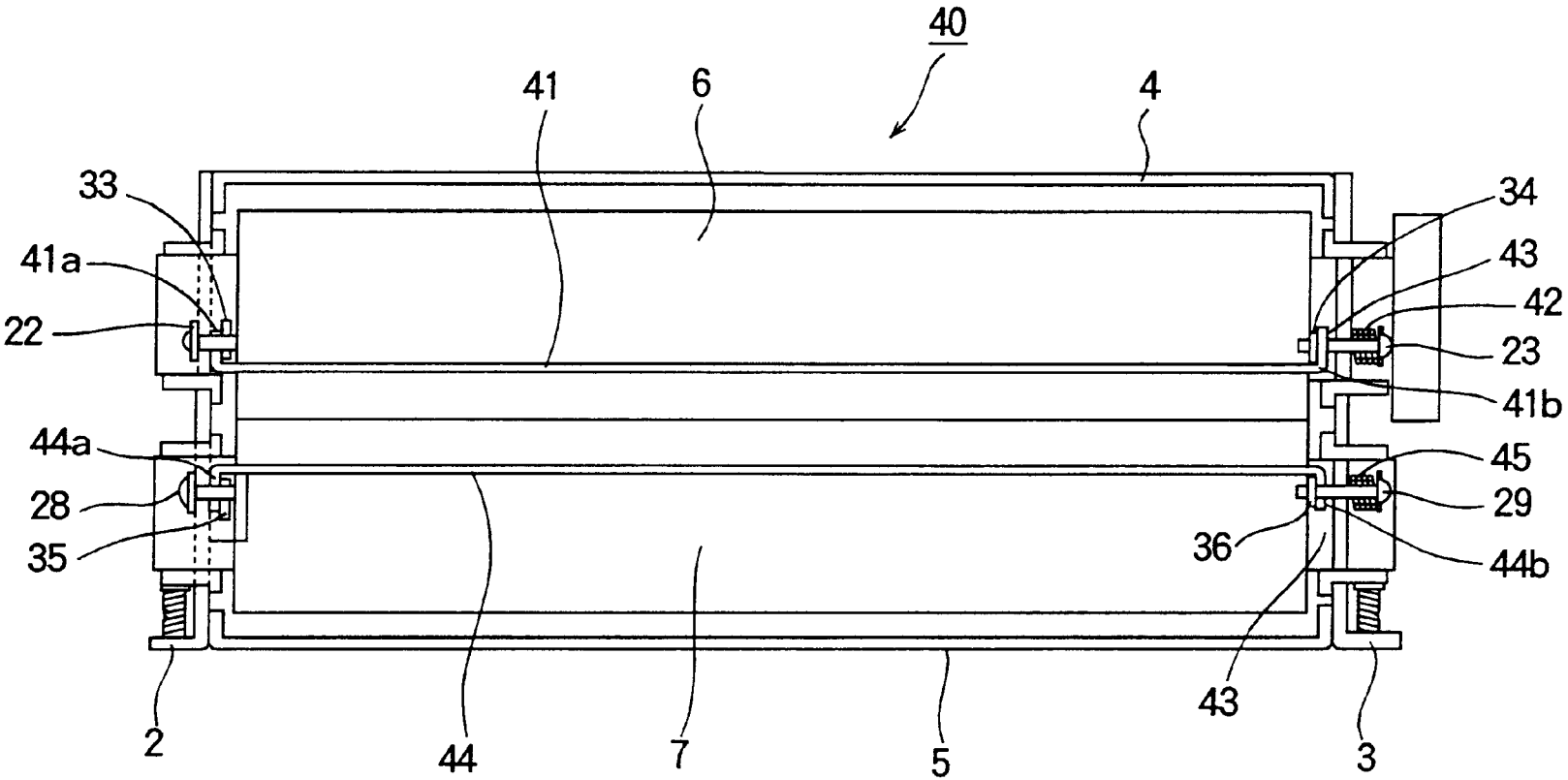
FIG. 10 is a front view of a fixing unit according to a third embodiment.

FIG. 10 is a front view of a fixing unit 40 according to a third embodiment.

Figure 11:
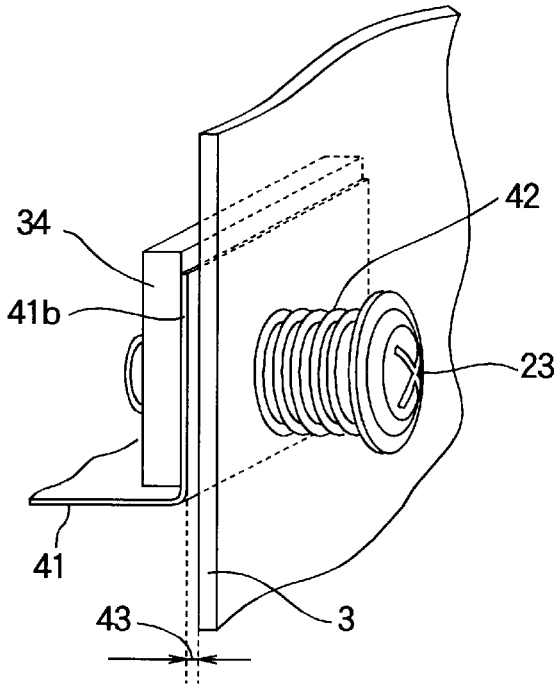
FIG. 11 is a perspective view illustrating three pertinent portions.

FIG. 11 is a perspective view, illustrating three pertinent portions of the fixing unit 40.

The third embodiment differs from the second embodiment in that a different configuration is used to absorb the thermal expansion of a separator plate 41.

Referring to FIG. 10, a fixing unit 40 according to the third embodiment includes a left side frame 2, a right side frame 3, an upper frame 4, and a lower frame 5. The fixing roller 6 and pressure roller 7 are rotatably supported on the left and right side frames 2 and 3.

A separator plate 41 extends across and in parallel to a length of the fixing roller 6. The separator plate 41 is fixed to the left side frame 2 and the right side frame 3 by means of screws 22 and 23. A mounting portion 41*a* of the separator plate 41 is fixed between the right side frame 2 and a washer 33 by means of the screw 22. A mounting portion 41*b* of the separator plate 41 is fixed between the right side frame 3 and a washer 34 by means of the screw 23 and a compression spring 42. As shown in FIG. 11, the separator plate 41 has a length shorter than the distance between the left side frame 2 and the right side frame 3, so that there is a gap 43 between the right side frame 3 and the mounting portion 41*b*. A screw hole, not shown, is formed in the mounting portion 41*b* of the separator plate 41 and has a larger diameter than the screw 23, thereby allowing some play of the mounting portion 41*b* in the hole.

A separator plate 44 extends in a direction parallel to the pressure roller 7 and is fixed to the left side frame 2 and right side frame 3 by means of screws 28 and 29. A mounting portion 44*a* of the separator plate 44 is fixed between the left side frame 2 and a washer 35. A mounting portion 44*b* on the other side is fixed between a washer 36 and right side frame 3 by means of the screw 29 and a compression spring 45. Just as the mounting portion 44*a*, the mounting portion 44*b* of the separator plate 44 is disposed to define a gap 43 between the right side frame 3

The operation of the third embodiment will be described. In the same manner as the first embodiment, the fixing unit 40 performs a fixing operation and separator plate 44 performs a separation operation in which a print medium is separated from the fixing roller 6. When the separator plate 41 expands thermally due to the heat generated by a heater roller, not shown, built in the fixing roller 6, the mounting portion 41*b* of the separator plate 41 moves toward the right side frame 3. Because there is the gap 43 between the right side frame 3 and the mounting portion 41*b*, the mounting portion 41*b* can move toward the right side frame 3 without difficulty. In other words, the separator plate 41*c*an absorb heat expansion while keeping its position horizontal. When the main portion of the separator plate 41 expands thermally, the mounting portion 41*b* may move vertically. However, in the present embodiment, the mounting portion 41*b* has a large screw hole formed therein, and therefore, the mounting portion 41*b* can move vertically so that the separator plate 41 does not deform.

Further, when the separator plate 44 expands thermally, the mounting portion 44*b* of the separator plate 44 moves toward the right side frame 3. Because there is the gap 43 formed between the right side frame 3 and the mounting portion 44*b*, the mounting portion 44*b* moves toward the right side frame 3 without difficulty. In other words, the thermal expansion of the separator plate 44 can be absorbed while maintaining the separator plate 44 flat and horizontal.

As described above, in the third embodiment, because the upper and lower separator plates 41 and 44 move while maintaining their flat and horizontal orientations, the height of the transport path of the print medium can be ensured.

Modifications of the third embodiment will be described.

Figure 12:
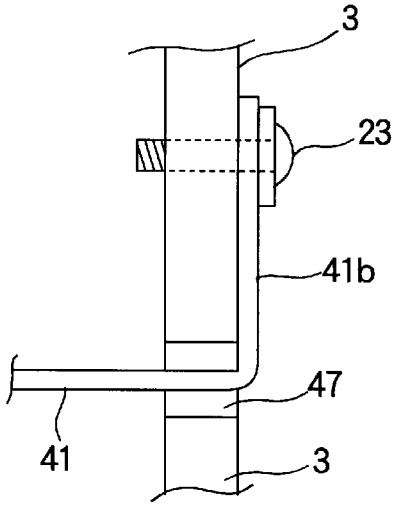
FIG. 12 illustrates a first modification of the third embodiment.
Figure 13:
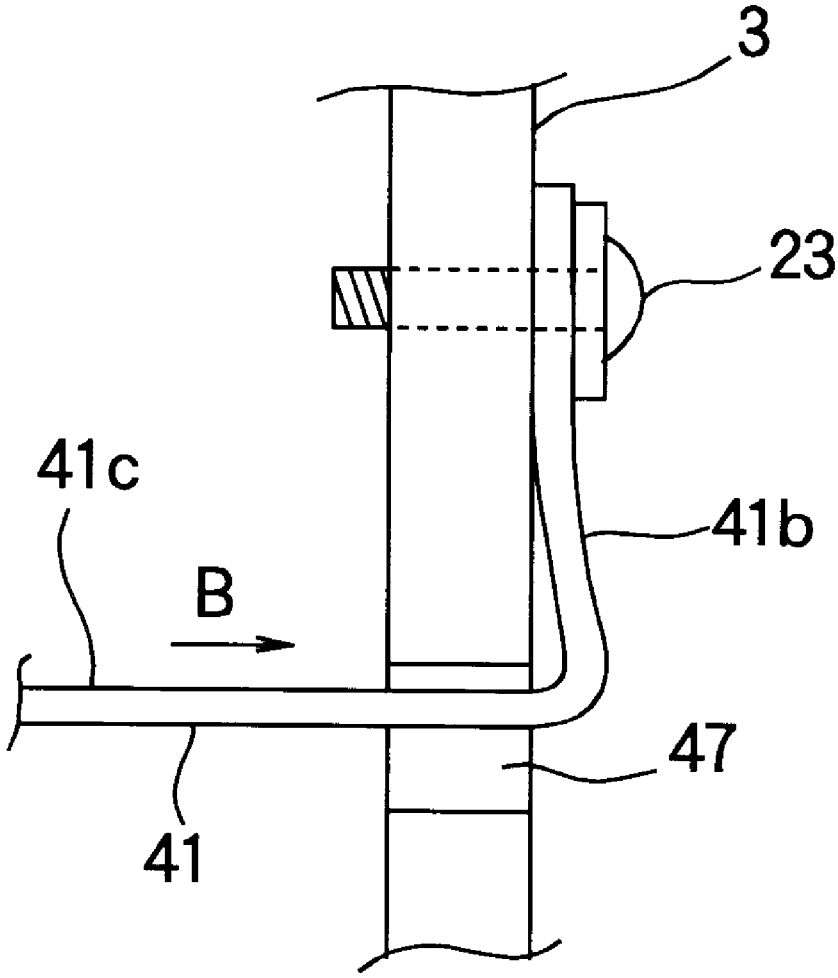
FIG. 13 illustrates the first modification of the third embodiment.

FIGS. 12 and 13 illustrate a first modification of the third embodiment.

Referring to FIG. 12, the separator plate 41 is formed of a resilient body and the mounting portion 41*b* is fixed to the outer side of the right side frame 3 by means of the screw 23. The separator plate 41 extends through a hole 47 outwardly of the right side frame 3.

When the separator plate 41 expands thermally, the longitudinally extending portion 41*c* of the separator plate 41 expands in a direction shown by arrow B shown in FIG. 13. There is no obstacle that restricts the movement of the separator plate 41. Therefore, the longitudinally extending portion 41*c* expands in the direction shown by arrow B, so that the mounting portion 41*b* deforms as shown in FIG. 13 to absorb the thermal expansion of the separator plate 41.

As described above, the first modification not only offers the same advantages as the third embodiment but also reduces the number of parts and assembly time required.

Figure 14:
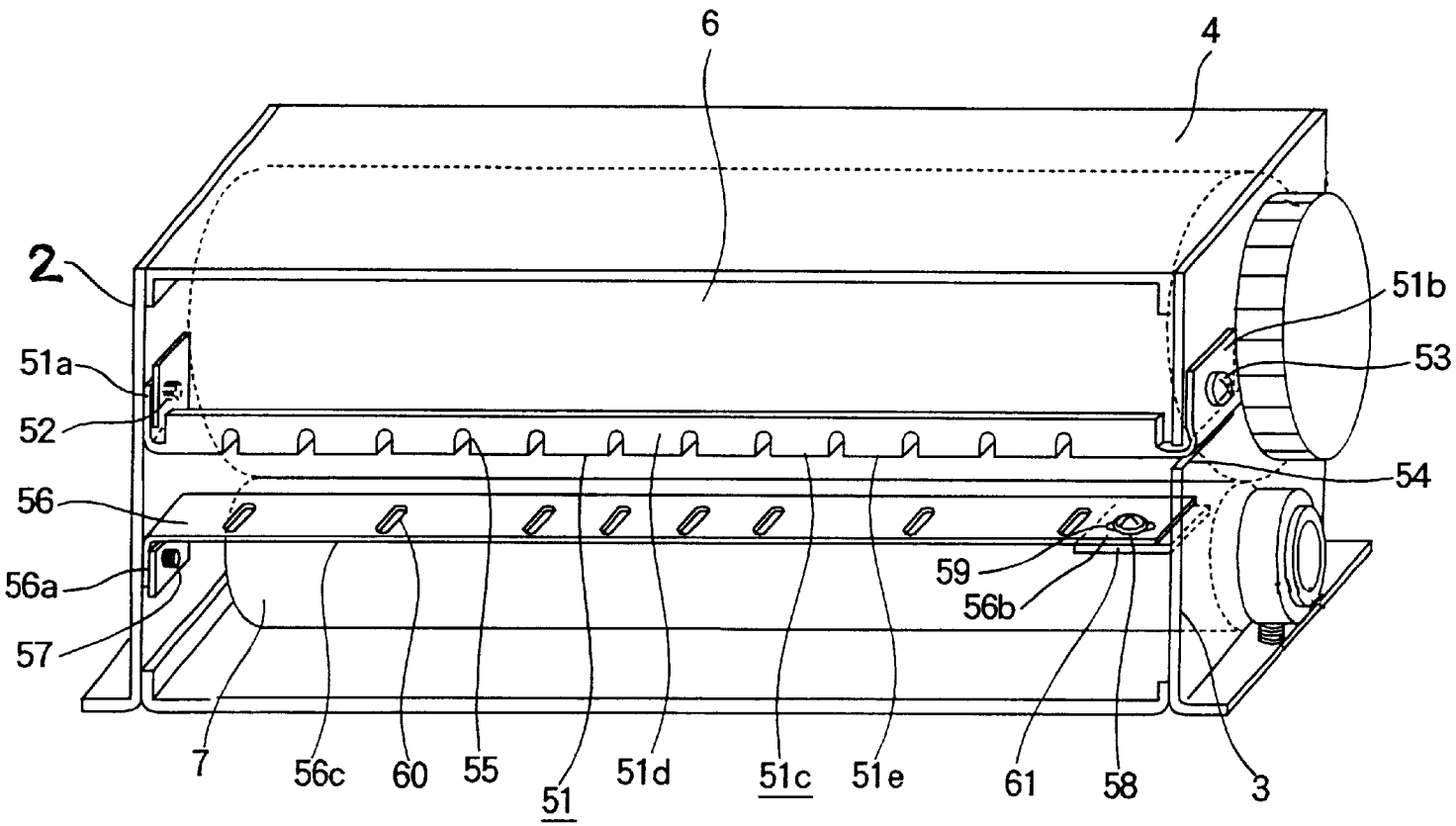
FIG. 14 is a perspective view illustrating a second modification of the third embodiment.

FIG. 14 is a perspective view, illustrating a second modification of the third embodiment.

Figure 15:
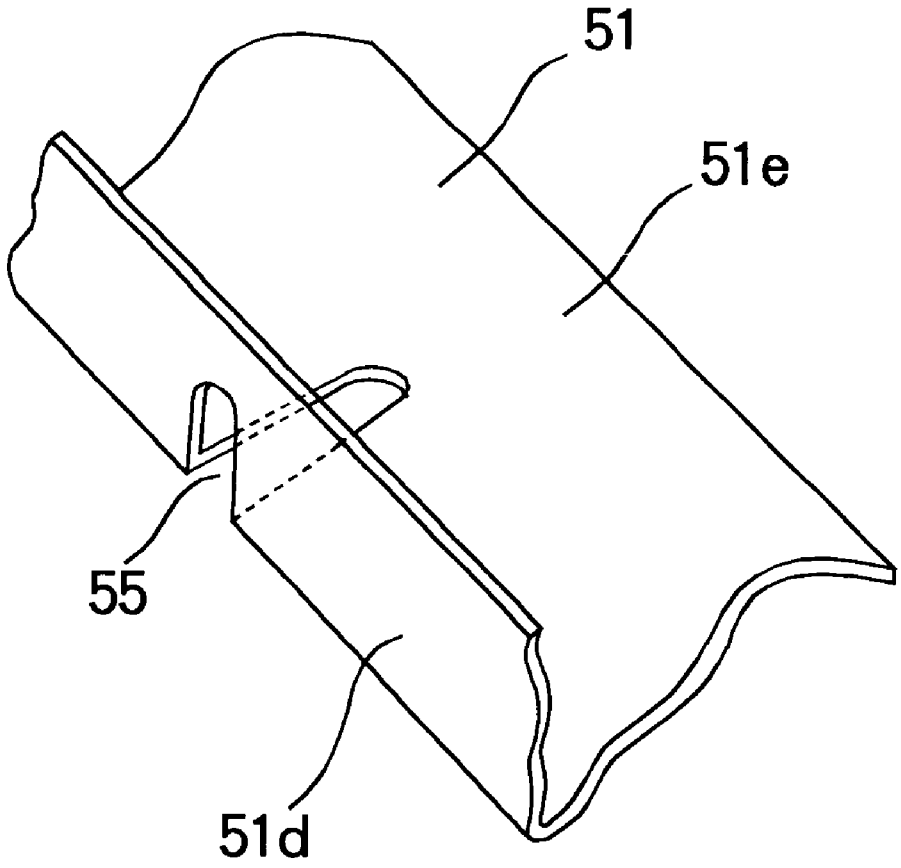
FIG. 15 is a perspective view of a second modification of the second embodiment.

FIG. 15 is a fragmentary perspective view of the second modification.

Referring to FIG. 14, in the second modification, an upper separator plate 51 has a generally U-shaped cross section and mounting portions 51*a* and 51*b* formed at two opposing ends. The mounting portion 51*a* is fixed to an inner side of the left side frame 2 by means of a screw 52. The mounting portion 51*b* is fixed to the right side frame 3 from an outer side by means of a screw 53. The separator plate 51 extends outwardly of the fixing unit through a cutout 54 formed in the right side frame 3. The separator plate 51 is formed of a resilient material. Just as in the first modification, the longitudinally extending portion 51*c* extends in a longitudinal direction due to thermal expansion and the mounting portions 51*b* deform.

The longitudinally extending portion 51*c* of the separator plate 51 includes a vertical portion 51*d* and a horizontal portion 51*e*. The longitudinally extending portion 51*c* is formed with a plurality of openings 55 each of which has a portion formed in the vertical portion 51*d* and another portion formed in the horizontal portion 51*e*. The openings 55 are provided to allow steam and water drops resulting from moisture deposited on the print medium 19 and toner to escape. The openings 55 prevent deformation of a print medium due to steam trapped near the separator plate 51 and deterioration of images due to the fact that the print medium contacts the separator plate 51 or water drops are deposited on the separator plate 51.

The width of the openings 55 formed in the horizontal portion 51*e* changes gradually along the direction of travel of the print medium in such a way that the openings 55 are narrower at an upstream end and wider at a downstream end. This shape of the openings 55 prevents the corners of the print medium 19 from being caught by the openings 55 when the print medium contacts the separator plate 51. The openings 55 have a portion formed in the vertical portion 51*d* of the separator plate 51, the portion opening in the direction of travel of the print medium to further reduce the chance of the print medium being caught by the openings 55.

A lower separator plate 56 is formed of a resilient body and has a longitudinally extending portion 56*c* and mounting portions 56*a* and 56*b* at opposed end portions. The mounting portions 56*a* is fixed to the inner side of the left side frame 2 by means of a screw 57. The mounting portion 56*b* on the opposite side to the mounting portion 56*a* is fixed to a mounting plate 61, mounted to the inner side of the right side frame 3, by means of the screw 58. The mounting portion 56*b* is formed with an elongated hole 59 therein that extends in the longitudinal direction of the separator plate 56. The mounting portion 56*b* is fastened by means of a screw 58 inserted through the elongated hole 59 so that the separator plate 56 is allowed to move in the longitudinal direction due to thermal expansion.

The longitudinally extending portion 56*c* of the separator plate 56 is formed with a plurality of holes 60 therein. The holes 60 are provided to bypass steam and water drops resulting from moisture deposited on the print medium and toner. The holes 60 prevent deformation of the print medium due to steam trapped near the separator plate 56 and deterioration of images due to the fact that the print medium contacts the separator plate 56 or water drops are deposited on the separator plate 56. As shown in FIG. 14, the holes 60 are formed at locations except areas through which the left and right ends of the print medium pass, so that the corners of the print medium are not caught in the holes 60.

As described above, the second modification not only offers the same advantages as the first modification. The second modification also prevents deformation of the print medium due to steam trapped near the separator plate and deterioration of images due to the fact that the print medium contacts the separator plate or water drops are deposited on the separator plate.

Fourth Embodiment

Figure 16:
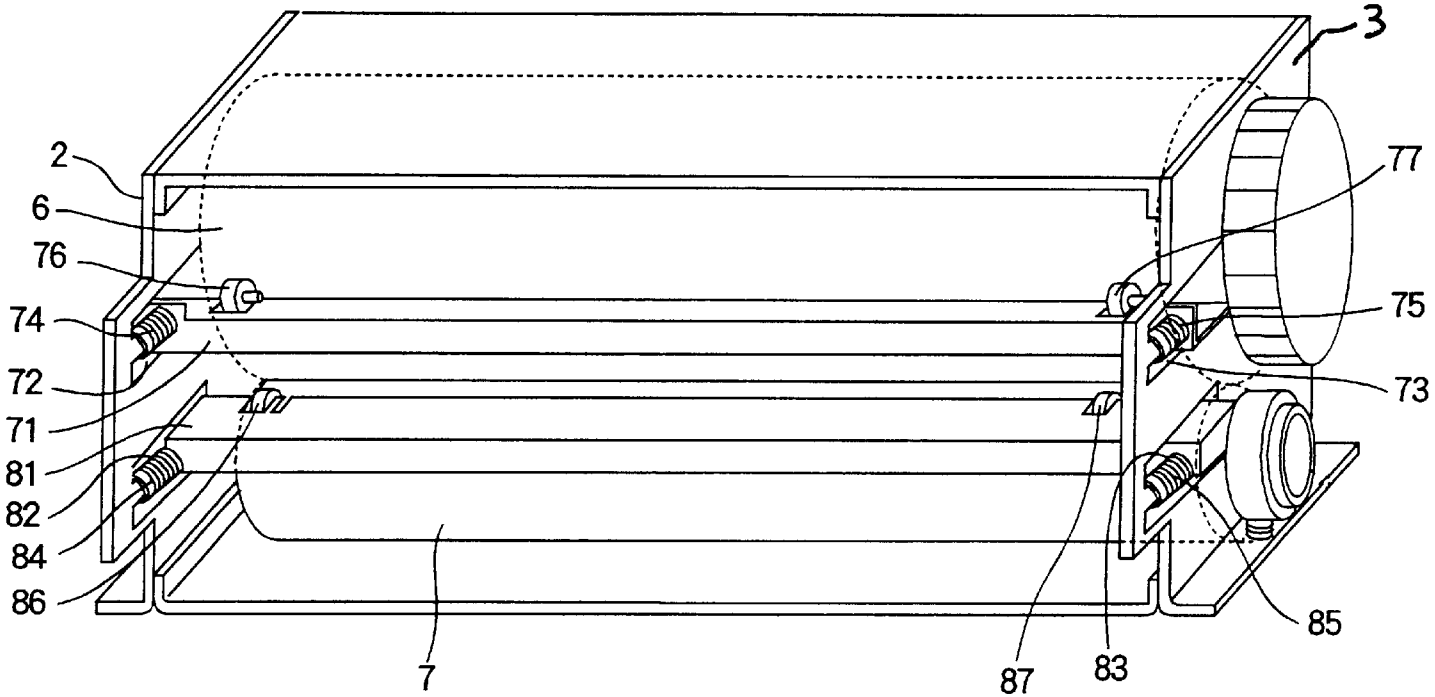
FIG. 16 is a perspective view illustrating a fixing unit according to a fourth embodiment.

FIG. 16 is a perspective view, illustrating a fixing unit according to a fourth embodiment.

Figure 17:
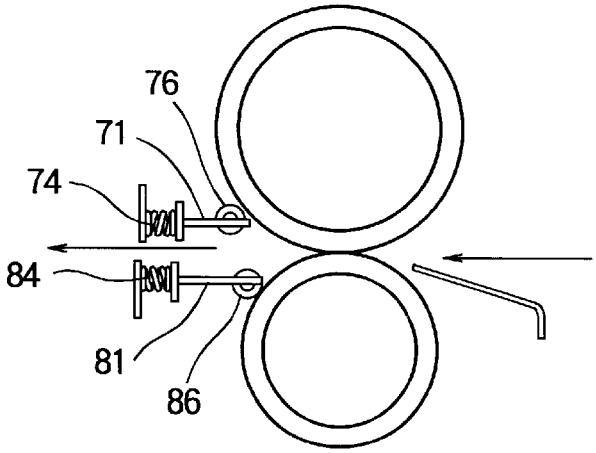
FIG. 17 is a cross-sectional side view of the fixing unit.

FIG. 17 is a cross-sectional side view of the fixing unit.

Figure 18:
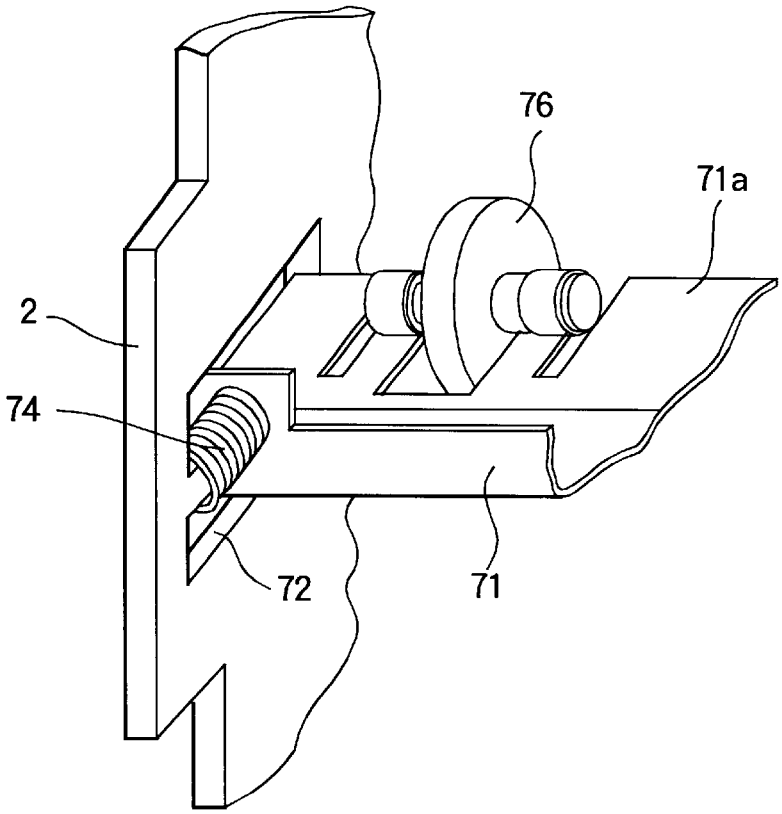
FIG. 18 is a perspective view of a pertinent portion of the fixing unit.

FIG. 18 is a perspective view of a pertinent portion of the fixing unit.

The fourth embodiment includes a means for maintaining the separator plate 71 and fixing roller 6 spaced apart from each other by a certain distance.

Referring to FIGS. 16 and 17, a separator plate 71 is disposed between the left side frame 2 and the right side frame 3. The separator plate 71 has an L-shaped cross section and extends into a receiving hole 72 formed in the left side frame 2 and a receiving hole 73 formed in the left side frame 3 in such a way that the separator plate 71 is movably supported. A spring 74 is received in the receiving hole 72 and urges one end of the separator plate 71 toward the fixing roller 6. A spring 75 is received in the receiving hole 73 and urges the other end of the separator plate 71 toward the fixing roller 6.

As shown in FIG. 18, a contact roller 76 is rotatably mounted to one end of the separator plate 71 and a contact roller 77 is rotatably mounted to the other end of the separator plate 71. The springs 74 and 75 urge the separator plate 71 toward the fixing roller 6, so that the contact rollers 76 and 77 are in pressure contact with the fixing roller 6. Thus, a constant distance is maintained between the tip 71*a* of the separator plate 71 and the fixing roller 6. The contact rollers 76 and 77 are mounted on the left and right ends of the transport path of the print medium so that print medium usually traveling through the transport path does not move into contact with the contacts rollers 76 and 77.

A separator plate 81 is disposed on the pressure roller side. The separator plate 81 has a substantially L-shaped cross-section and has one end extending into a receiving hole 82 formed in the left side frame 2 and the other end extending into a receiving hole 83 formed in the right side frame 3. A spring 84 is received in the receiving hole 82 and urges one end of the separator plate 81 toward the pressure roller 7. A spring 85 is received in the receiving hole 83 and urges the other end of the separator plate 81 toward the pressure roller 7.

Contact rollers 86 are rotatably mounted to one end of the separator plate 81 and contact rollers 87 are rotatably mounted to the other end of the separator plate 81. The springs 84 and 85 urge the separator plate 81 toward the pressure roller 7 so that the contact rollers 86 and 87 are in pressure contact with the pressure roller 7. Thus, a constant distance is maintained between the tip of the separator plate 81 and the pressure roller 7.

With the fourth embodiment, the separator plate 71 is always urged toward the surface of the fixing roller 6. Therefore, the gap between the tip 71*a* of the separator plate 71 and the fixing roller 6 is maintained constant, facilitating stable separation of the print medium from the fixing roller 6.

Figure 19:
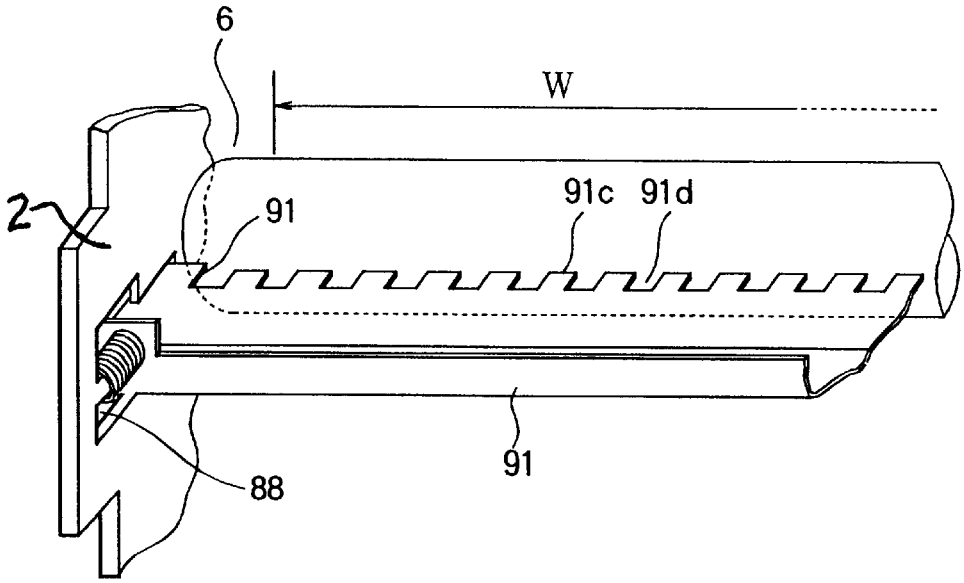
FIG. 19 is a perspective view of a modification of the fourth embodiment.

FIG. 19 is a perspective view of a modification of the fourth embodiment.

Figure 20:
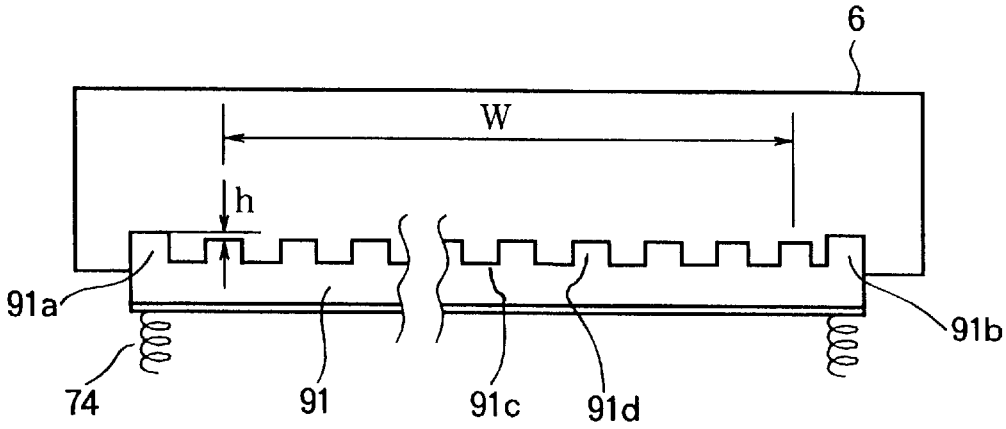
FIG. 20 is a top view illustrating the modification.

FIG. 20 is a top view illustrating the modification. A separator plate 91 includes end portions 91*a* and 91*b*, a plurality of projections 91*c*, and a plurality of cutouts 91*d*. The end portions 91*a* and 91*b* are received in a slit communicating with a hole 88 in the left side frame 2 and a slit communicating with a hole (not shown) in the right side frame 3, respectively. The end portions 91*a* and 91*b*are supported so that the separator plate 91 is slidable in the slits toward and away from the fixing roller 6. Springs (only spring 74 is shown) are received in the holes (only hole 88 is shown) formed in the left and right side frames 2 and 3, respectively, and urges the end portions 91*a* and 91*b* of the separator plate 91 against the circumferential surface of the fixing roller 6. The plurality of projections 91*c* are shorter than end portions 91*a* and 91*b* by a distance h, and the end portions 91*a* and 91*b* abut the left side frame 2 and the right side frame 3. In this manner, the separator plate 91 is positioned so that the plurality of projections 91*c* are a predetermined distance away from the surface of the fixing roller 6. Also, the separator plate 91 is positioned in such a way that the end portions 91*a* and 91*b* are outside of an area W through which a print medium passes. In other words, the separator plate 91 has a span greater than a width of the print medium so that the print medium passes within the span. Therefore, the slight wear of areas on the surface of the fixing roller 6 in pressure contact with the separator plate 91 does not adversely affect the printer quality and the transport of the print medium. Just as the openings 55 in the third embodiment, the plurality of cutouts 91*d* serves to bypass vapor and drops of water. This modification not only provides the same advantages as the fourth embodiment but also reduces the number of components by forming the separator plate 91 in one piece construction. The properties required of the separator plate 91 are: resistance to deformation due to the heat of the fixing roller 6, friction resistance, small thermal expansion, and hardness of the same or less than that of the fixing roller 6. Therefore, resin materials having good heat resistance and good resistance to wear are used. The materials include polyimide and PEEK (polyetheretherketon). The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fixing unit in which a toner image deposited on a print medium is fused by heat under pressure, the fixing unit comprising:

a fixing member in pressure contact with a pressurizing member; and a first separator plate that is disposed close to said fixing member and has a longitudinal portion extending in a direction transverse to a transport path of the print medium.

2. The fixing unit according to claim 1, further comprising a guide member, wherein the longitudinal portion has resiliency to extend away from the transport path, and the guide member pushes a mid portion of the longitudinal portion to prevent the longitudinal portion from extending away from the transport path.

3. The fixing unit according to claim 1, wherein the longitudinal portion of said first separator plate is allowed to expand in a longitudinal direction thereof when the longitudinal portion is heated.

4. The fixing unit according to claim 3, further comprising a first urging member that absorbs thermal expansion of said first separator plate and urges said first separator plate in the longitudinal direction.

5. The fixing unit according to claim 3, wherein said first separator plate is formed of a resilient body expandable in the longitudinal direction when the longitudinal portion is heated.

6. The fixing unit according to claim 3, wherein said first separator plate is fastened in such a way that said first separator plate is expandable in the longitudinal direction.

7. The fixing unit according to claim 1, wherein a distance between said first separator plate and said fixing member is in the relation of $0<d<-R+\sqrt{R^2+L^2}$ where R is a radius of the fixing member and L is a top margin of the print medium.

8. The fixing unit according to claim 1, further comprising projections provided at longitudinal ends of said first separator plate, the projections being in contact with said fixing member and projecting closer to said fixing member than the longitudinal portion to maintain a predetermined gap between said fixing member and said longitudinal portion.

9. The fixing unit according to claim 8, wherein the projections are formed in a one piece construction with said first separator plate.

10. The fixing unit according to claim 1, further comprising a roller that is rotatably supported and contacts said fixing member to maintain said fixing member and said first separator plate spaced apart by a certain distance.

11. The fixing unit according to claim 1, further comprising a second separator plate that is disposed close to said fixing member and has a longitudinal portion extending in a direction transverse to the transport path of the print medium.

12. The fixing unit according to claim 11, wherein said second separator plate has a hole formed in its longitudinal portion.

13. The fixing unit according to claim 1, wherein said first separator plate has a plurality of openings aligned in the direction traverse to the transport path.

14. The fixing unit according to claim 1, wherein said first separator plate has a plurality of cutouts that are aligned in the direction traverse to the transport path and directly facing said fixing member.

15. The fixing unit according to claim 1, wherein the longitudinal portion includes a first plate-like portion and a second plate-like portion that extend in the direction transverse to the transport path of the print medium and make an angle with each other, wherein the longitudinal portion has a plurality of openings each of which has a first opening portion formed in the first plate-like portion and a second opening portion formed in the second plate-like portion.

16. The fixing unit according to claim 1, wherein said first separator plate has a span greater than a width of the print medium so that the print medium passes within the span.

17. The fixing unit according to claim 1, wherein said first separator plate is made of a resin material.

18. The fixing unit according to claim 1, wherein said first separator plate has at least one opening that opens in the direction transverse to the transport path of the print medium.

* * * * *